US005692436A

United States Patent [19]

Pishioneri

[11] Patent Number: 5,692,436

[45] Date of Patent: Dec. 2, 1997

[54] CAN CRUSHER DEVICE

[76] Inventor: Albert Frederic Pishioneri, 3 Fulton St., Freehold, N.J. 07728

[21] Appl. No.: 534,269

[22] Filed: Sep. 26, 1995

[51] Int. Cl.[6] ..... B30B 9/32

[52] U.S. Cl. ..... 100/137; 100/233; 100/293; 100/902

[58] Field of Search ..... 100/137, 233, 100/258 A, 293, 902

[56] References Cited

U.S. PATENT DOCUMENTS

| | | | |
|---|---|---|---|
| 1,727,979 | 9/1929 | Hunt | 100/293 |
| 2,446,898 | 8/1948 | Alvarez | 100/233 |
| 3,374,730 | 3/1968 | Cain | 100/233 |
| 3,641,929 | 2/1972 | Ballard | 100/233 |
| 3,651,754 | 3/1972 | Forest | 100/233 |
| 3,776,129 | 12/1973 | Carlson . | |
| 4,213,387 | 7/1980 | McCaney et al. . | |
| 4,383,480 | 5/1983 | Jerden . | |
| 4,498,385 | 2/1985 | Manley . | |
| 4,561,351 | 12/1985 | Ader | 100/233 |
| 5,218,902 | 6/1993 | Triola . | |

FOREIGN PATENT DOCUMENTS

| | | | |
|---|---|---|---|
| 0512504 | 10/1992 | European Pat. Off. | 100/902 |

*Primary Examiner*—Stephen F. Gerrity
*Attorney, Agent, or Firm*—Joseph Januszkiewicz

[57] ABSTRACT

A can crusher device that has a base member with an upper surface connected by linkages to a moveable plate member with a lower planar surface wherein the linkages includes levers that interconnect the forward portions of the base and plate members as well as the rearward portions of the base and plate members in a parallelogram type of linkage so that on movement of the levers the lower surface of the plate member is maintained in a parallel relationship to the upper surface of the base member during the crushing action on the can. The force exerted on the can is an endwise downward force along the full longitudinal length of the can.

9 Claims, 4 Drawing Sheets

CAN CRUSHER DEVICE

BACKGROUND OF THE INVENTION

This invention relates to a can crushing device and more particularly to a new and improved can crushing device and to the method of crushing such cans.

The recycling of cans, particularly beverage cans, has increased in use for ecological and economic reasons. Such recycling requires temporary storage and since such cans occupy a relatively large volume with little relative weight it has become increasingly important to reduce the volume by crushing or flattening such cans to make recycling convenient for all parties involved. It is more advantageous to crush the cans on their sides for ease of handling.

SUMMARY OF THE INVENTION

The present invention is directed to a can crusher for flattening empty cans, more easily using less energy with a device and method that is simpler than heretofore done.

According to the present invention the crushing device uses a pair of spaced platens or members wherein one member is a stationary base that supports the can to be crushed. The other member is a movable platen that is connected to the base by linkage means so as to impart a crushing force over the entire longitudinal length of the can as a single force. On pivotal movement of the movable member there is exerted by the movable member on the can that is an endwise downward force along the full length of the can. The upper surface of the base member and the lower surface of the moveable platen or member are maintained in parallel relationship during the entire crushing and flattening action by the linkage means that acts in the manner of a parallelogram. This action requires much less strength or force than that in crushing a can from its top circular surface to its bottom circular surface along its vertical longitudinal axis or perpendicularly downwardly on its longitudinal axis.

These and other objectives achieved by this invention will become apparent as this description proceeds in connection with the accompanying drawings.

BRIEF DESCRIPTION OF THE DRAWINGS

For a detailed description of the preferred embodiments of the invention reference will be made to the accompanying drawings wherein.

DETAILED DESCRIPTION OF THE INVENTION

Figure 1:
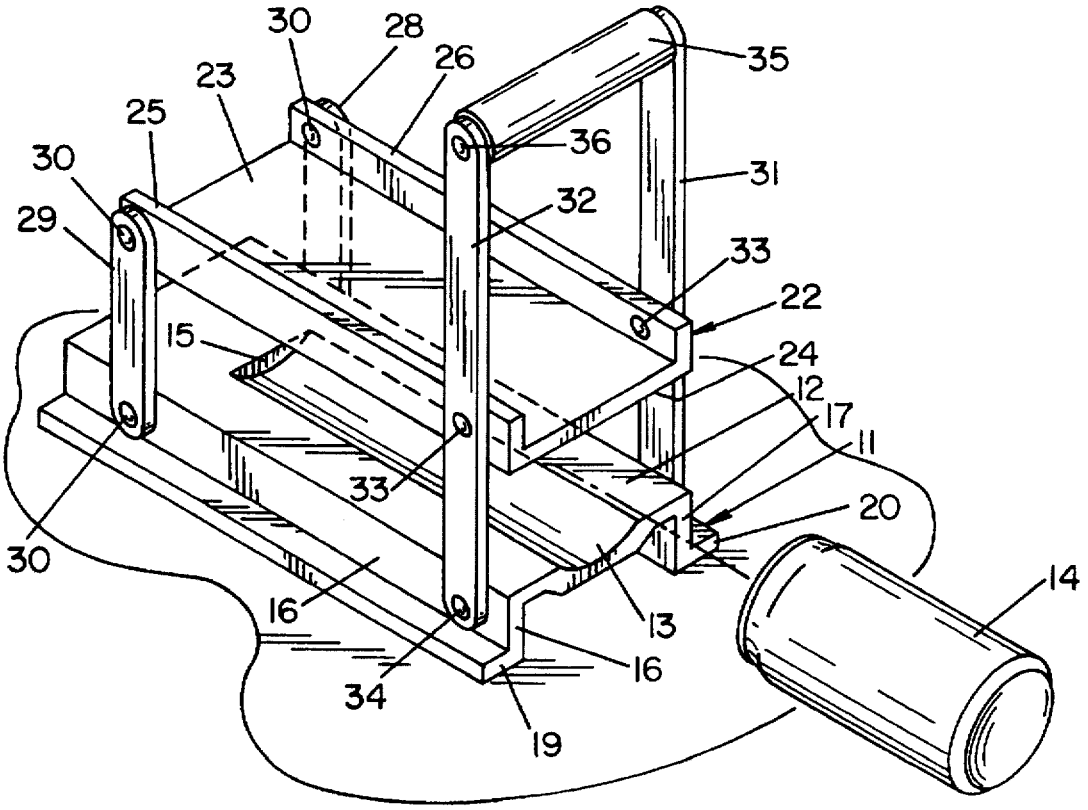
FIG. 1 is a perspective view of the can crushing device in the can receiving position with a can shown ready to be received by such device.

Referring now to the drawings, wherein like reference numerals designate like or corresponding parts throughout the several views, there is shown in FIG. 1 a lower plate, base member or base 11, which base 11 may rest via its leg members on the counter top of a kitchen or be suitably attached to a wall. The base 11 has an upper surface 12 which has a longitudinally extending arcuate recess 13 for centering a beverage can 14. The juncture of the recess 13 with the forward portion of the surface 12 defines a shoulder 15 that acts as a stop for the positioning of a can thereon. Base 11 has a pair of downwardly extending side walls 16 and 17 with laterally extending leg members 19 and 20 respectively.

Pivotally mounted above base 11 is an upper plate member, upper plate or pressure plate 22, which upper plate 22 has an upper surface 23 and a lower planar surface 24. Upper plate 22 has a pair of spaced upwardly extending side walls 25 and 26.

Interconnecting the forward portion of upper plate 22 to the forward portion of base 11 are links or levers 28 and 29 as by lock pins or rivets 30. The rearward portion of base 11 is pivotally connected to the rearward portion of upper plate 22 by elongated levers or lever members 31 and 32 as by lock pins or rivets 33 and 34. Rivets 34 pivotally connect the lower end portions of the levers 31 and 32 to the base 11 while the rivets 33 pivotally connect the respective intermediate portions of levers 31 and 32 to the side walls 26 and 25 of upper plate 22. The distance or length of levers 28 and 29 between upper and lower pins 30 is the same as the distance on the respective levers 31 and 32 between pins 33 and 34. Similarly the distance between pins 30 and 33 on the upper plate 22 is the same as the distance between pins 30 and 34 on the base 11, thus forming a parallelogram type of linkage means between the upper plate 22 and base 11 to maintain the lower surface 24 (of upper plate 22) parallel at all times to the upper surface 12 of base 11 as the linkage means move the upper plate 22 towards the base 11. The uppermost end portions of levers 31 and 32 are interconnected by a handle 35 as by pins or rivets 36.

Figure 6:
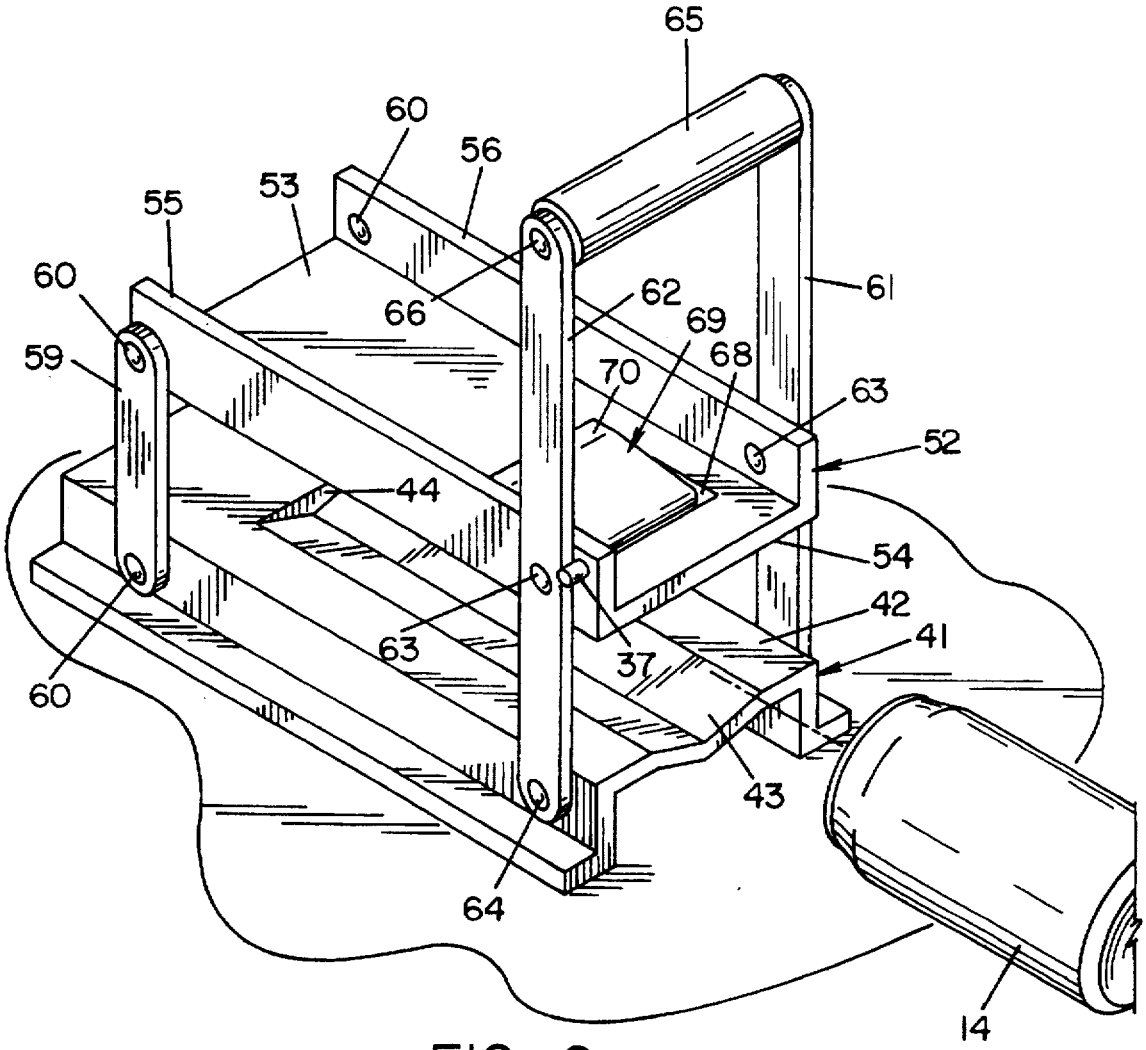
FIG. 6 is a perspective view of a modified can crushing device showing a pivotal cam therein.
Figure 7:
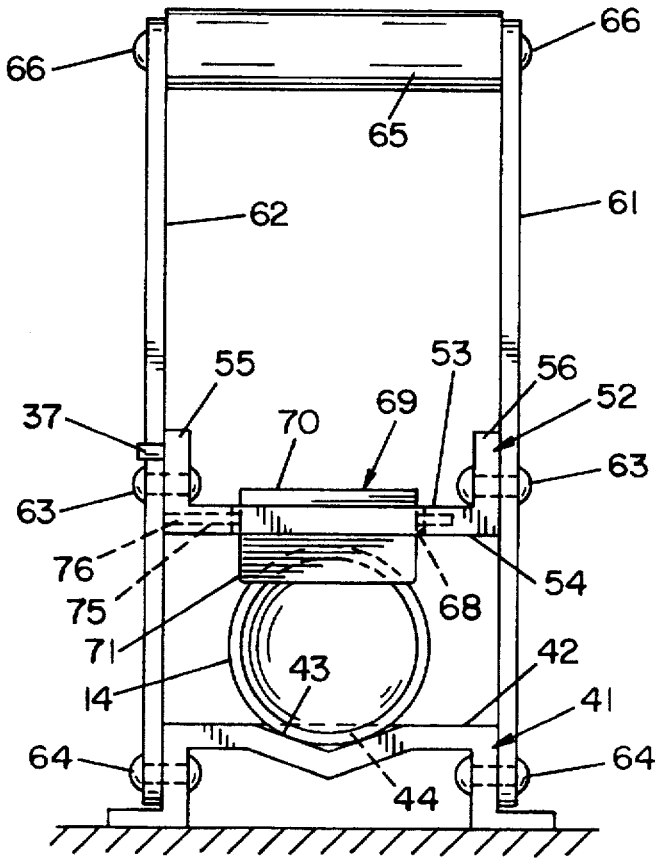
FIG. 7 is an end view of the modified can crushing device shown in FIG. 6.
Figure 8:
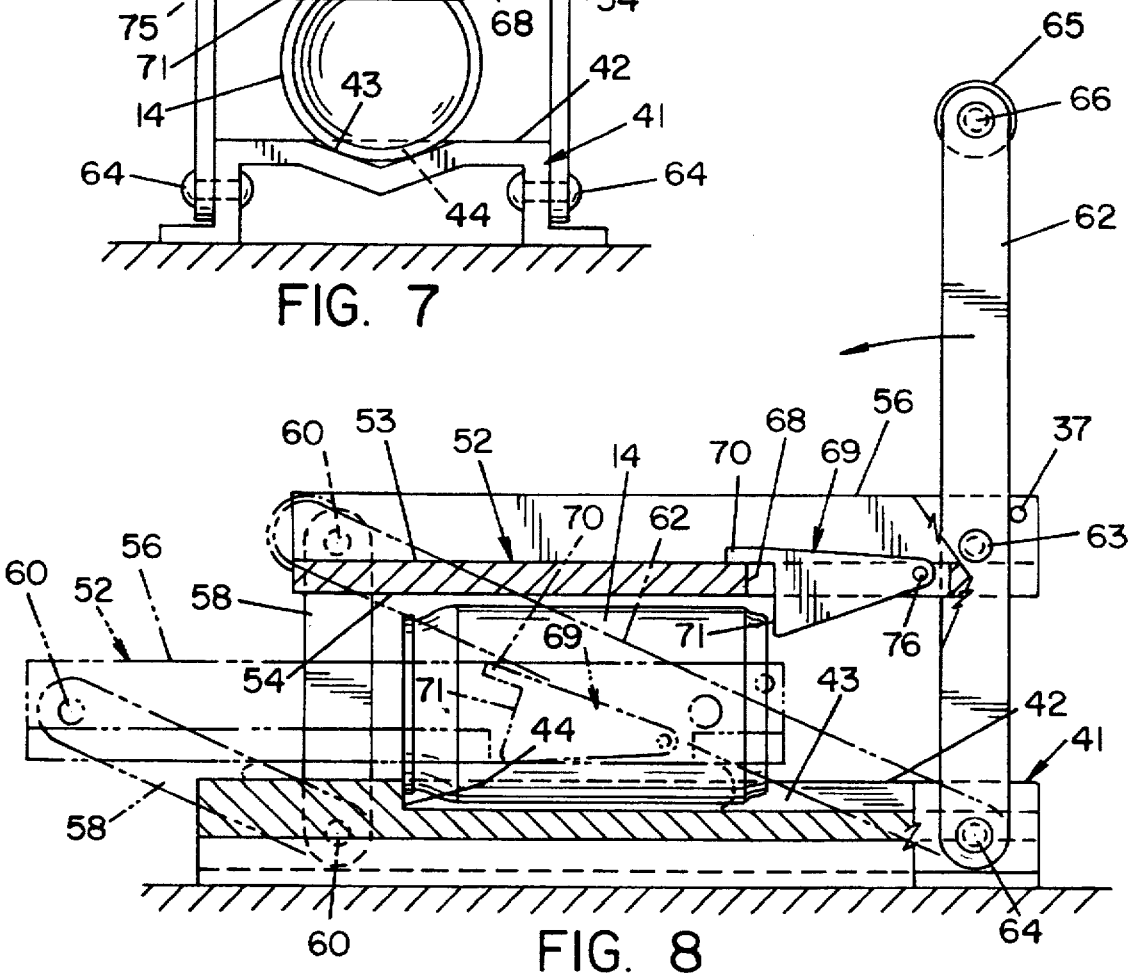
FIG. 8 is a side elevational view of the modified can crusher device of FIG. 6 with a portion of the upper and lower platen members broken away.

A modification of the invention is shown in FIGS. 6–8, wherein the base 41 is similar to that shown in the first described embodiment except that base 41 has its recess 43 V-shaped in cross-sectional configuration in lieu of the recess being arcuate. Such recess 43 is a can alignment recess or crease and acts to line up or align the longitudinal center line of the can or cylindrical container with the apex of the V-shaped recess 43. The juncture of such V-shaped recess 43 with the forward portion of a top surface 42 (of base 41) defines a shoulder 44 similar to shoulder 15 as in the first embodiment that acts as a stop for centering the cylindrical can.

Pivotally mounted above base 41 is an upper platen member, upper plate or pressure plate 52, which upper plate 52 has an upper surface 53 and a lower planar surface 54. Upper plate 52 has a pair of spaced upwardly extending side walls 55 and 56. Interconnecting the forward portion of upper plate 52 to the forward portion of base 41 are links or levers 58 and 59 as by lock pins or rivets 60 as in the first embodiment. The rearward portion of base 41 is pivotally connected to the rearward portion of upper plate 52 by elongated levers or lever members 61 and 62 as by lock pins or rivets 63 and 64. Rivets 64 pivotally connect the lower end portions of the levers 61 and 62 to the base 41 while the rivets 63 pivotally connect the respective intermediate portions of levers 61 and 62 to the side walls 56 and 55 of the upper plate 52. The distance or length of levers 58 and 59 between upper and lower pins or rivets 60 is the same as the distance on the respective levers 61 and 62 between rivets 63 and 64. Similarly the distance between rivets 60 and 63 on the upper plate 52 is the same as the distance between pins or rivets 60 and 64 on the base 41, thus forming a parallelogram type of linkage means between the upper plate 52 and the base 41 to maintain the lower surface 54 parallel at all times to the upper surface 42 of base 41 as the linkage means moves the upper plate 52 towards the base 41. The uppermost end portions of levers 61 and 62 are interconnected by a handle 65 and rivets 66.

The rearwardly disposed portion of the upper plate 52 adjacent to levers 61 and 62 has a rectangular shaped opening 68 that extends therethrough. Pivotally mounted in such opening 68 is an elongated pawl 69 having an upper abutment 70 that abuts the upper surface 53 of plate 52 to maintain the pawl 69 from dropping through the opening 68 and having a forwardly disposed shoulder 71 that is adapted to contact the rearwardly disposed uppermost portion of a cylindrical can. The rearwardly disposed portion of upper plate 52 has a pair of aligned bores 75 that communicate with the rear portion of opening 68 to receive a pin 76 upon which pawl 69 can pivot. Pin 76 extends through bores in the upper plate 52 and through a bore in the rear portion of pawl 69 adjacent to levers 61 and 62. Pawl 69, as viewed in FIG. 8, will pivot clockwise about pivot pin 76 to permit the insertion of a can 14 on V-shaped recess 43. Can 14 will abut shoulder 44 while pawl 69 will pivot about pin 76 in a counterclockwise direction (FIG. 8) until abutment 70 contacts the upper surface 53, and be in a position to engage the back of can 14 when the handle is pulled or pivoted forward. This action will facilitate the can crushing operation.

The above described pawl 69 can be installed as part of the first embodiment but for clarity sake is only shown in FIGS. 6, 7 and 8. A stop 37 may be suitably attached or secured to the rearwardly disposed portion of upper plate 52 as a modification of such upper plate as shown in FIGS. 6–8. Such stop permits the lever members 61 and 62 to move a small angle beyond a predetermined perpendicular direction in a clockwise direction from that shown in FIG. 6 to facilitate the placing of a can 14 into the can crusher chamber, which chamber is defined by the base 41 with its recess 43 and the upper plate 52 along with levers 58, 61 and 62. Stop 37 is sufficiently to the right of the vertical alignment of pins 63–64 as viewed in FIG. 6 to permit the retention of the levers 61–62 in a position slightly clockwise of that shown in FIG. 6. Such stop 37 may also be attached to the rearwardly disposed portion of upper plate 22 for the same purpose of limiting the clockwise movement of levers 31 and 32.

Figure 2:
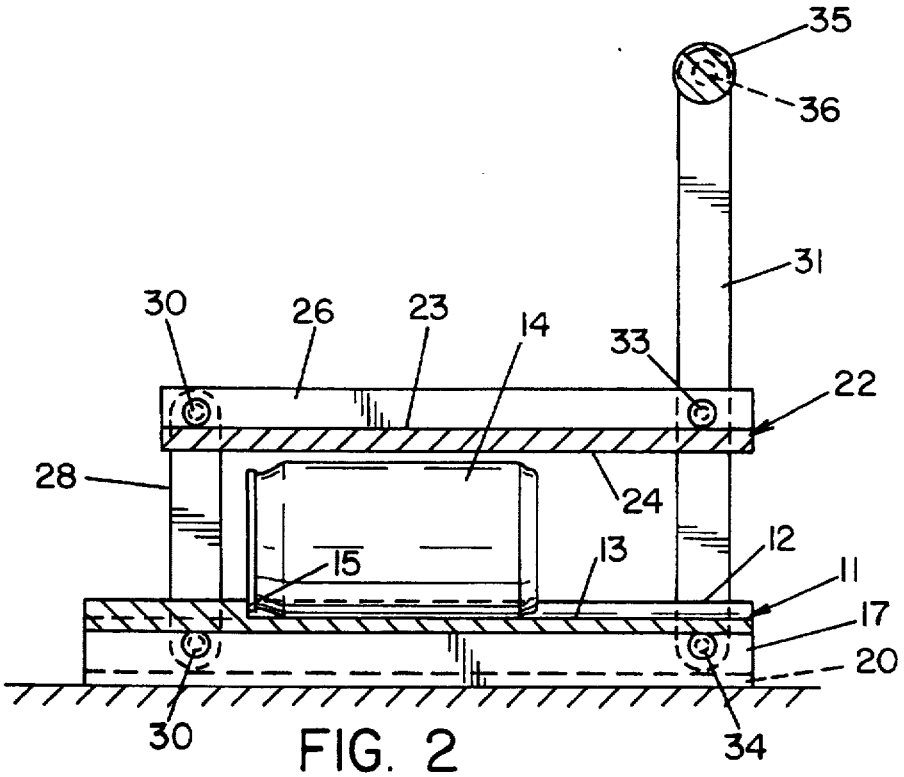
FIG. 2 is a side elevational view of the can crusher device having a can received by the device in position for crushing with a portion of the upper and lower platen members broken away to better illustrate the device.
Figure 3:
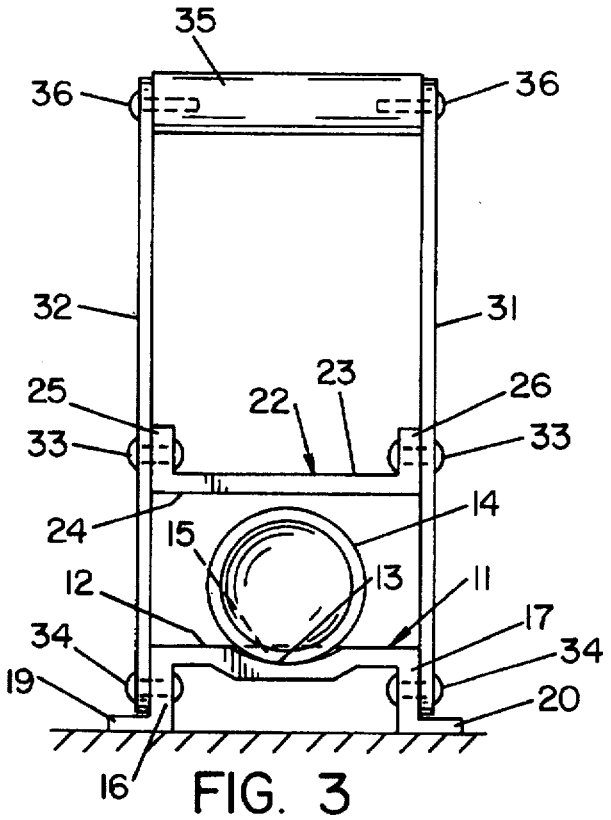
FIG. 3 is an end view of the device.
Figure 4:
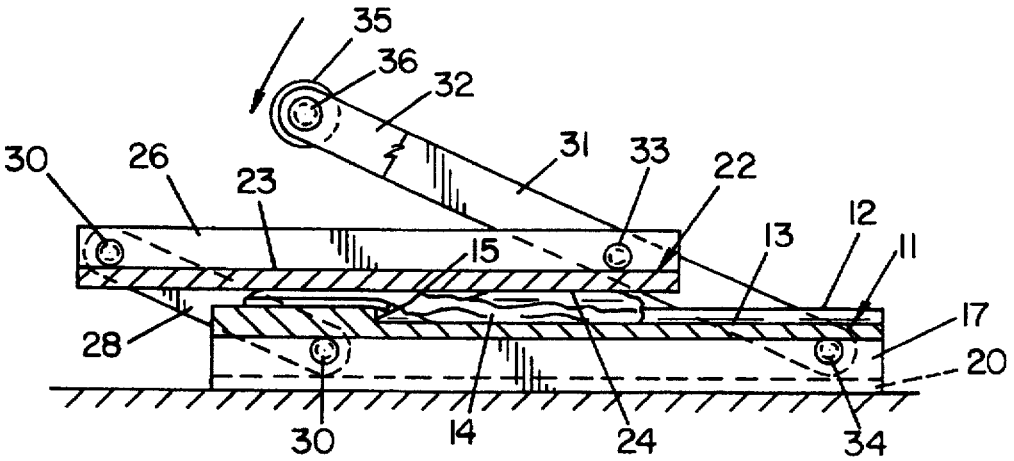
FIG. 4 is a side elevational view of can crusher device similar to that of FIG. 2 illustrating the can in a can flattened or crushed condition.
Figure 5:
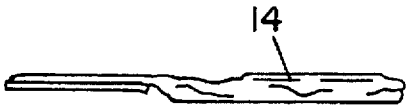
FIG. 5 is a side elevational view of a can in a crushed or flattened condition.

In the operation of the above described can crusher, a can 14 is placed in the chamber defined between the base 11 and the upper plate 22 along with the confinement of the levers 28, 29, 31 and 32 with the circular top of the can coming into abutting contact with the shoulder 15 as depicted by FIG. 2. The operator then via handle 35 moves the levers 31 and 32 in a counterclockwise direction from that shown in FIG. 2 to that shown in FIG. 4. This action of crushing is achieved by the lower surface 24 of the upper plate 22 making full contact with the full length of the can 14. Further counterclockwise movement of the levers 31–32 exerts an endwise downward force along the full longitudinal length of the can which pivots the circular top of the can as well as the circular bottom of the can as in a counterclockwise direction from that of FIG. 2 to that of FIG. 4. This action is a folding over of the circular top and circular bottom of the can from vertical planar conditions to a horizontal planar conditions.

The operation of the second embodiment is substantially similar to that of the first embodiment just described except that the pawl 69 facilitates the can crushing operations by using the shoulder 71 on pawl 69 to aid in the novel crushing action by using shoulder 71 to help fold over the rearwardly disposed circular bottom of the can (i.e. the circular portion of the can closer to the rear levers 61 and 62) as the upper plate or platen 52 is moved in an endwise downward movement (i.e. counterclockwise movement as viewed in FIG. 6. This action folds over the circular top of the can as well as the circular bottom of the can.

It will be apparent that, although a specific embodiment and certain modifications of the invention have been described in detail, this invention is not limited to the specifically illustrated and described constructions since variations may be made without departing from the principles of the invention.

What is claimed is:

1. A can crusher comprising a base member having an upper surface with a forward portion and a rearward portion, a centrally disposed recess extending from said rearward portion towards said forward portion to receive a cylindrical can thereon, a moveable plate member with a lower surface substantially parallel to said upper surface of said base member, lever means pivotally interconnecting said plate member to said forward portion and said rearward portion of said base member, said lever means having handle means for exerting movement to said plate member relative to said base member, said lever means being configured to provide a parallelogram linkage means between said plate member and said base member to maintain said lower surface of said plate member parallel to said upper surface of said base member at all times during movement of said plate member towards said base member by said lever means, said plate member has a pawl pivotally mounted thereon to permit passage of a can onto said recess, and said pawl having a forwardly disposed shoulder operative to exert an endwise downward force to help fold the adjacent circular portion of a cylindrical can from a vertical planar condition to a horizontal planar condition.

2. A can crusher comprising a base member having an upper surface with a forward portion and a rearward portion, a centrally disposed recess extending from said rearward portion towards said forward portion to receive a cylindrical can thereon, a moveable plate member with a lower surface substantially parallel to said upper surface of said base member, lever means pivotally interconnecting said plate member to said base member, said lever means having handle means for exerting movement to said plate member relative to said base member, said lever means being configured to maintain said lower surface of said plate member parallel to said upper surface of said base member at all times during movement of said plate member towards said base member by said lever means, the juncture of said centrally disposed recess with said forward portion of said upper surface of said base member defines a shoulder to position a cylindrical can on said recess, and said plate member has a stop member to limit the arcuate movement of said plate member relative to said base member.

3. A can crusher as set forth in claim 2 wherein said centrally deposed recess is arcuately shaped to provide a centering means for a can disposed thereon.

4. A can crusher as set forth in claim 3 wherein said plate member has a pawl pivotally mounted thereon to permit passage of a can onto said centrally deposed recess for contact with said shoulder on said recess, and said pawl having a forwardly disposed shoulder operative to abut the adjacent circular portion of a cylindrical can to exert a folding force thereon as said plate member is moved towards said base member.

5. A can crusher as set forth in claim 2 wherein said centrally disposed depression is V-shaped in cross-section to facilitate the centering of a cylindrical can thereon.

6. A can crusher as set forth in claim 5 wherein said plate member has a pawl pivotally mounted thereon to permit passage of a can onto said centrally disposed recess, and said pawl having a forwardly disposed shoulder operative to abut the adjacent circular portion of a cylindrical can to exert a folding force thereon as said plate member is moved towards said base member.

7. A can crusher comprising a base member having an upper planar surface, said surface having a centrally disposed recess thereon that provides a shoulder at the juncture of said recess with said planar surface of said base member to locate a cylindrical can onto said recess, said base member having a forwardly disposed portion and a rearwardly disposed portion, a plate member having a lower planar surface, said plate member having a forwardly disposed portion and a rearwardly disposed portion, first lever means pivotally interconnecting said forward portions of said base member and said plate member, second lever means pivotally interconnecting said rearwardly disposed portions of said base member and said plate member, said upper surface of said base member being parallel to said lower surface of said plate member, the distance of said first lever means between their pivotal connection to said plate member and said base member being equal to the distance of said second lever means between their pivotal connection to said plate member and said base member, said distance between pivotal connections on said plate member to said first and said second lever means is equal to the distance between pivotal connections on said base member to said first and second lever means, and said second lever means has an extension that extends beyond said plate member to facilitate the movement of said plate member relative to said base member to crush a can positioned between said plate member and said base member, a pawl member is pivotally mounted on said plate member to permit movement of a cylindrical can thereagainst and onto said recess for abutting contact by a circular end portion of such can with said shoulder on said recess, and said pawl having a forwardly disposed shoulder operative to exert an endwise downward force to fold the adjacent circular end portion of such cylindrical can from a vertical planar condition to a horizontal planar condition as said plate member moves toward said base member.

8. A can crusher as set forth in claim 7 wherein a stop member is located on the rearwardly disposed plate member to limit the arcuate movement of said plate member relative to said base member.

9. A can crusher comprising a base member having an inner surface and an outer surface wherein said outer surface rests on a counter or attached to a support, said inner surface having a forward portion and a rearward portion, said base having a forward end and a rearward end, a centrally disposed recess on said base extending from said rearward portion toward said forward portion to receive a cylindrical can thereon, a moveable plate member with an inner surface facing said inner surface of said base member, said moveable plate member having a forward end and a rearward end, lever means pivotally interconnecting said forward and said rearward ends of said plate member to said forward and said rearward ends respectively of said base member to provide a parallelogram linkage that maintains said inner surface of said moveable plate member parallel to said inner surface of said base member to effect a crushing action of a can solely between said inner surfaces of said plate member and said base member, and said lever means having an extension with handle means for pivoting said plate member relative to said base member.

* * * * *